US008847516B2

(12) United States Patent
Chobot

(10) Patent No.: US 8,847,516 B2
(45) Date of Patent: Sep. 30, 2014

(54) LIGHTING DEVICES INCLUDING CURRENT SHUNTING RESPONSIVE TO LED NODES AND RELATED METHODS

(75) Inventor: Joseph P. Chobot, Morrisville, NC (US)

(73) Assignee: Cree, Inc., Durham, NC (US)

( * ) Notice: Subject to any disclaimer, the term of this patent is extended or adjusted under 35 U.S.C. 154(b) by 27 days.

(21) Appl. No.: 13/323,074

(22) Filed: Dec. 12, 2011

(65) Prior Publication Data

US 2013/0147359 A1 Jun. 13, 2013

(51) Int. Cl.
*H05B 37/02* (2006.01)

(52) U.S. Cl.
USPC ..... 315/307; 315/210; 315/250

(58) Field of Classification Search
USPC ..... 315/169.3, 185 R, 246, 291, 307, 308, 315/312; 345/102, 213, 504, 519, 520, 522
See application file for complete search history.

(56) References Cited

U.S. PATENT DOCUMENTS

| | | | |
|---|---|---|---|
| 3,638,042 | A | 1/1972 | Studtmann |
| 3,655,988 | A | 4/1972 | Nakamura et al. |
| 3,913,098 | A | 10/1975 | Nakamura et al. |
| 5,059,788 | A | 10/1991 | Tashiro et al. |
| 5,125,675 | A | 6/1992 | Engelbrecht |
| 5,357,120 | A | 10/1994 | Mori |
| 5,467,049 | A | 11/1995 | Kida et al. |
| 5,598,068 | A | 1/1997 | Shirai |
| 5,646,760 | A | 7/1997 | Kuijk et al. |
| 5,798,520 | A | 8/1998 | Kuijk et al. |
| 6,396,718 | B1 | 5/2002 | Ng et al. |
| 6,411,155 | B2 | 6/2002 | Pezzani |
| 6,501,630 | B1 | 12/2002 | Colclaser et al. |
| 6,784,622 | B2 | 8/2004 | Newman, Jr. et al. |
| 7,109,664 | B2 | 9/2006 | Wu |
| 7,213,940 | B1 | 5/2007 | Van De Ven et al. |
| 7,307,391 | B2 | 12/2007 | Shan |
| 7,427,838 | B2 | 9/2008 | Hosoya |
| 7,439,945 | B1 | 10/2008 | Awalt et al. |
| 7,550,934 | B1 | 6/2009 | Deng et al. |

(Continued)

FOREIGN PATENT DOCUMENTS

| | | | |
|---|---|---|---|
| EP | 1 020 935 | A2 | 7/2000 |
| EP | 1 594 348 | A2 | 11/2005 |

(Continued)

OTHER PUBLICATIONS

International Search Report Corresponding to International Application No. PCT/US11/54846; Date of Mailing: Jan. 23, 2012; 13 pages.

(Continued)

*Primary Examiner* — Thienvu Tran
*Assistant Examiner* — Christopher Lo
(74) *Attorney, Agent, or Firm* — Myers Bigel Sibley & Sajovec, P.A.

(57) ABSTRACT

A solid state lighting device may include a power supply and a light emitting device electrically coupled between the power supply and a reference node, with the light emitting device defining a node. A control element may be provided in a current shunting path electrically coupled in parallel with the light emitting device between the power supply and the reference node, with the control element being configured to control a voltage drop across the current shunting path responsive to an electrical signal from the node of the light emitting device. Related methods are also discussed.

32 Claims, 8 Drawing Sheets

(56) References Cited

U.S. PATENT DOCUMENTS

| | | | | |
|---|---|---|---|---|
| 7,821,194 | B2 | 10/2010 | Negley et al. | |
| 7,967,652 | B2 | 6/2011 | Emerson | |
| 8,148,911 | B2 | 4/2012 | Chen et al. | |
| 8,188,682 | B2 | 5/2012 | Nalbant | |
| 8,294,388 | B2 | 10/2012 | Wong et al. | |
| 8,525,774 | B2 * | 9/2013 | Lin et al. | 345/102 |
| 8,618,748 | B2 | 12/2013 | Shiu et al. | |
| 2001/0032985 | A1 | 10/2001 | Bhat et al. | |
| 2002/0043943 | A1 | 4/2002 | Menzer et al. | |
| 2002/0139987 | A1 | 10/2002 | Collins, III et al. | |
| 2004/0042205 | A1 | 3/2004 | Tanabe et al. | |
| 2004/0183380 | A1 | 9/2004 | Otake | |
| 2005/0179629 | A1 * | 8/2005 | Inoue | 345/82 |
| 2006/0049782 | A1 | 3/2006 | Vornsand et al. | |
| 2006/0176411 | A1 | 8/2006 | Furukawa | |
| 2006/0221609 | A1 | 10/2006 | Ryan, Jr. | |
| 2006/0244396 | A1 | 11/2006 | Bucur | |
| 2007/0013620 | A1 * | 1/2007 | Tanahashi et al. | 345/82 |
| 2007/0108843 | A1 | 5/2007 | Preston et al. | |
| 2007/0115228 | A1 | 5/2007 | Roberts et al. | |
| 2007/0115662 | A1 | 5/2007 | Roberts et al. | |
| 2007/0196023 | A1 | 8/2007 | Kang et al. | |
| 2008/0018261 | A1 | 1/2008 | Kastner | |
| 2008/0024071 | A1 | 1/2008 | Yu | |
| 2008/0122376 | A1 | 5/2008 | Lys | |
| 2008/0130283 | A1 | 6/2008 | Chang | |
| 2008/0150440 | A1 | 6/2008 | Hsu | |
| 2008/0211415 | A1 | 9/2008 | Altamura | |
| 2008/0252197 | A1 | 10/2008 | Li et al. | |
| 2009/0039791 | A1 | 2/2009 | Jones | |
| 2009/0140630 | A1 | 6/2009 | Kijima et al. | |
| 2009/0160363 | A1 | 6/2009 | Negley et al. | |
| 2009/0184616 | A1 | 7/2009 | Van De Ven et al. | |
| 2010/0060175 | A1 | 3/2010 | Lethellier | |
| 2010/0109537 | A1 * | 5/2010 | Nishino et al. | 315/185 R |
| 2010/0109570 | A1 * | 5/2010 | Weaver | 315/295 |
| 2010/0225251 | A1 | 9/2010 | Maruyama | |
| 2010/0259182 | A1 | 10/2010 | Man et al. | |
| 2010/0308738 | A1 | 12/2010 | Shteynberg et al. | |
| 2010/0308739 | A1 | 12/2010 | Shteynberg et al. | |
| 2011/0068696 | A1 | 3/2011 | van De Ven et al. | |
| 2011/0068702 | A1 | 3/2011 | Van De Ven et al. | |
| 2011/0074292 | A1 | 3/2011 | Maehara | |
| 2011/0148314 | A1 * | 6/2011 | Lin et al. | 315/192 |
| 2011/0309760 | A1 | 12/2011 | Beland et al. | |
| 2012/0313545 | A1 | 12/2012 | Courtel | |

FOREIGN PATENT DOCUMENTS

| | | | |
|---|---|---|---|
| JP | 59-113768 | A | 6/1984 |
| JP | 4 196359 | A | 7/1992 |
| WO | WO 2007/023454 | A1 | 3/2007 |

OTHER PUBLICATIONS

International Search Report Corresponding to International Application No. PCT/US2012/069085; Date of Mailing: Feb. 20, 2013; 10 Pages.

International Preliminary Report on Patentability Corresponding to International Application No. PCT/US2011/054846; Date of Mailing: May 16, 2013; 10 Pages.

Notification of Transmittal of the International Search Report and the Written Opinion of the International Searching Authority, or the Declaration, International Search Report, and Written Opinion of the International Searching Authority, PCT International Application No. PCT/US2006/011820, Aug. 7, 2006.

Chobot, Joseph Paul, United States Patent Application No. 12/987,485, "Systems and Methods for Controlling Solid State Lighting Devices and Lighting Apparatus Incorporating Such Systems and/or Methods", Filing Date, Jan. 10, 2011.

International Search Report and Written Opinion Corresponding to International Application No. PCT/US12/69079; Date of Mailing: Feb. 28, 2013; 20 Pages.

Chinese Office Action (33 pages) corresponding to Chinese Patent Application No. 201080053242; Issue Date: Nov. 27, 2013.

Extended Search Report Corresponding to International Application No. PCT/US2011054846; Date of Mailing: Feb. 17, 2014; 7 Pages.

Extended European Search Report corresponding to European Application No. 10819249.3, Date of Mailing: Mar. 27, 2014, 8 pages.

* cited by examiner

LIGHTING DEVICES INCLUDING CURRENT SHUNTING RESPONSIVE TO LED NODES AND RELATED METHODS

FIELD OF THE INVENTION

The present invention relates to lighting, and more particularly to solid state lighting.

BACKGROUND

Solid state lighting devices are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 8, and the 1976 CIE u'v' Chromaticity Diagram, which is similar to the 1931 Diagram but is modified such that similar distances on the 1976 u'v' CIE Chromaticity Diagram represent similar perceived differences in color. These diagrams provide useful reference for defining colors as weighted sums of colors.

In a CIE-u'v' chromaticity diagram, such as the 1976 CIE Chromaticity Diagram, chromaticity values are plotted using scaled u' and v' parameters which take into account differences in human visual perception. That is, the human visual system is more responsive to certain wavelengths than others. For example, the human visual system is more responsive to green light than red light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 8, colors on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 8. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 8 generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

Also illustrated in FIG. 8 is the planckian locus 106, which corresponds to the location of color points of light emitted by a black-body radiator that is heated to various temperatures. In particular, FIG. 8 includes temperature listings along the black-body locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the black-body locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the planckian locus. Accordingly, a white point may be identified by a correlated color temperature (CCT) of the light source. White light typically has a CCT of between about 2000 K and 8000 K. White light with a CCT of 4000 may appear yellowish in color, while light with a CCT of 8000 K may appear more bluish in color. Color coordinates that lie on or near the black-body locus at a color temperature between about 2500 K and 6000 K may yield pleasing white light to a human observer.

"White" light also includes light that is near, but not directly on the planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the planckian locus may be considered to have the same color as the point on the planckian locus.

The ability of a light source to accurately reproduce color in illuminated objects is typically characterized using the color rendering index (CRI). In particular, CRI is a relative measurement of how the color rendering properties of an illumination system compare to those of a black-body radiator. The CRI equals 100 if the color coordinates of a set of test colors being illuminated by the illumination system are the same as the coordinates of the same test colors being irradiated by the black-body radiator. Daylight has the highest CRI (of 100), with incandescent bulbs being relatively close (about 95), and fluorescent lighting being less accurate (70-85).

For large-scale backlight and illumination applications, it is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs. Even with binning, however, LED lighting systems may still experience significant variation in color point from one system to the next.

One technique to tune the color point of a lighting fixture, and thereby utilize a wider variety of LED bins, is described in commonly assigned United States Patent Publication No. 2009/0160363, the disclosure of which is incorporated herein by reference. The '363 application describes a system in which phosphor converted LEDs and red LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device. LED lighting systems employing feedback to obtain a desired color point are described in U.S. Publication Nos. 2007/0115662 and 2007/0115228, the disclosures of which are incorporated herein by reference.

SUMMARY

According to some embodiments, a solid state lighting device may include a power supply and a light emitting device electrically coupled between the power supply and a reference node, with the light emitting device defining a node. A control element may be electrically coupled in a current shunting path in parallel with the light emitting device between the power supply and the reference node, with the control element being configured to control a voltage drop across the current shunting path responsive to an electrical signal from the node of the light emitting device.

The control element may be a regulating transistor, and a control electrode of the regulating transistor may be electrically coupled to the node of the light emitting device. In addition, a switching transistor may be electrically coupled in series with the regulating transistor in the current shunting path between the power supply and the reference node.

A mirroring transistor may be electrically coupled in series between the light emitting device and the reference node, with a control electrode of the mirroring transistor being electrically coupled to the control electrode of the regulating transistor. Moreover, the node of the light emitting device may be between the light emitting device and the mirroring transistor so that the control electrodes of the regulating transistor and the mirroring transistor are electrically coupled to the node between the light emitting device and the mirroring transistor.

The light emitting device may be one of a plurality of light emitting devices electrically coupled in series between the power supply and the mirroring transistor. The node between the light emitting device and the mirroring transistor may be a first node between the plurality of light emitting devices and the mirroring transistor, and the regulating transistor may be a first regulating transistor. In addition, a second regulating transistor may be electrically coupled in series in the current shunting path between the first regulating transistor and the power supply, with a control electrode of the second regulating transistor being electrically coupled to a second node between two of the plurality of light emitting devices.

The second regulating transistor may be a bipolar junction transistor, and at least one diode may be electrically coupled between the control electrode of the second regulating transistor and the second node. More particularly, the at least one diode may be used to provide that a voltage drop between the second node and the first regulating transistor is substantially matched with a voltage drop between the second node and the mirroring transistor. According to other embodiments, the second regulating transistor may be a field effect transistor, and a gate to source threshold voltage of the field effect transistor may be substantially matched with a voltage drop between the second node and the mirroring transistor.

In addition, a reverse biased Zener diode may be electrically coupled in series in the current shunting path between the regulating transistor and the power supply. Such a reverse biased Zener diode may be provided instead of or in addition to a second regulating transistor.

The light emitting device may be one of a plurality of light emitting devices electrically coupled in series between the power supply and the reference node. The node may be between two of the plurality of light emitting devices, and the control electrode of the regulating transistor may be electrically coupled to the node between the two of the plurality of light emitting devices.

The power supply may be a current controlled power supply, and the light emitting device may be a first light emitting device. A controller may be coupled to a control electrode of the switching transistor, with the controller being configured to generate a pulse width modulated control signal to vary a current though the current shunting path. A second light emitting device may be electrically coupled between the power supply and the reference node, with the first and second light emitting devices being electrically coupled in series between the power supply and the reference node. A sum of electrical currents through the first light emitting device and the current shunting path may be equal to an electrical current through the second light emitting device.

According to some embodiments of the present invention, a solid state lighting device may include a power supply and a light emitting device electrically coupled between the power supply and a reference node. In addition, a current shunting path may be electrically coupled in parallel with the light emitting device between the power supply and the reference node, and a voltage drop across the current shunting path may be controllable responsive to an electrical signal from a node of the light emitting device.

The current shunting path may include a switching transistor and a regulating transistor electrically coupled in series between the power supply and the reference node, and a control electrode of the regulating transistor may be electrically coupled to the node of the light emitting device.

In addition, a mirroring transistor may be electrically coupled in series between the light emitting device and the reference node, and a control electrode of the mirroring transistor may be electrically coupled to the control electrode of the regulating transistor. The node of the light emitting device may be between the light emitting device and the mirroring transistor so that the control electrodes of the regulating transistor and the mirroring transistor are electrically coupled to the node between the light emitting device and the mirroring transistor. The regulating transistor and the mirroring transistor may thus provide a current mirror structure.

The light emitting device may be one of a plurality of light emitting devices electrically coupled in series between the power supply and the mirroring transistor, and the node between the light emitting device and the mirroring transistor may be a first node between the plurality of light emitting devices and the mirroring transistor. Moreover, the regulating transistor may be a first regulating transistor, the current shunting path may further include a second regulating transistor electrically coupled in series between the first regulating transistor and the power supply, and a control electrode of the second regulating transistor may be electrically coupled to a second node between two of the plurality of light emitting devices.

The second regulating transistor may be a bipolar junction transistor, and at least one diode may be electrically coupled between the control electrode of the second regulating transistor and the second node. More particularly, the at least one diode may be used to provide that a voltage drop between the second node and the first regulating transistor is substantially matched with a voltage drop between the second node and the mirroring transistor. According to other embodiments, the second regulating transistor may be a field effect transistor, and a gate to source threshold voltage of the field effect transistor may be substantially matched with a voltage drop between the second node and the mirroring transistor.

The current shunting path may further include a reverse biased Zener diode electrically coupled in series between the regulating transistor and the power supply. Such a reverse biased Zener diode may be provided instead of or in addition to a second regulating transistor.

The light emitting device may be one of a plurality of light emitting devices electrically coupled in series between the power supply and the reference node, and the node may be between two of the plurality of light emitting devices. Moreover, the control electrode of the regulating transistor may be electrically coupled to the node between the two of the plurality of light emitting devices.

The power supply may be a current controlled power supply, and the light emitting device may be a first light emitting device. In addition, a controller may be coupled to a control electrode of the switching transistor, and the controller may be configured to generate a pulse width modulated control signal to vary a current though the current shunting path (e.g., to vary a duty cycle of the current through the current shunting path). In addition, a second light emitting device may be electrically coupled between the power supply and the reference node, the first and second light emitting devices may be electrically coupled in series between the power supply and the reference node, and a sum of electrical currents through the first light emitting device and the current shunting path may be equal to an electrical current through the second light emitting device.

According to some other embodiments of the present invention, a solid state lighting device may include a power supply and a light emitting device electrically coupled between the power supply and a reference node. A first mirroring transistor may be electrically coupled between the light emitting device and the reference node, and a second mirroring transistor may be electrically coupled in a current shunting path between the power supply and the reference node. A control electrode of the first mirroring transistor may be electrically coupled to a node between the light emitting device and the first mirroring transistor, and the current shunting path may be electrically coupled in parallel with light emitting device, with a control electrode of the second mirroring transistor being electrically coupled to the node between the light emitting device and the first mirroring transistor.

The light emitting device may be one of a plurality of light emitting devices electrically coupled in series between the power supply and the first mirroring transistor, and the node between the light emitting device and the first mirroring transistor may be a first node between the plurality of light emitting devices and the first mirroring transistor. In addition, a regulating transistor may be electrically coupled in series with the second mirroring transistor in the current shunting path between the second mirroring transistor and the power supply, and a control electrode of the regulating transistor may be electrically coupled to a second node between two of the plurality of light emitting devices.

The regulating transistor may be a bipolar junction transistor, and at least one diode may be electrically coupled between the control electrode of the regulating transistor and the second node. More particularly, one or a plurality of such diodes may be used to provide that a voltage drop between the reference node and the second mirroring transistor is substantially matched with a voltage drop between the reference node and the first mirroring transistor. According to some other embodiments, the regulating transistor may be a field effect transistor, and a gate to source threshold voltage of the field effect transistor may be substantially matched with a voltage drop between the reference node and the first mirroring transistor.

A Zener diode may be electrically coupled in series with the second mirroring transistor in the current shunting path, with the Zener diode being electrically coupled between the second mirroring transistor and the power supply. Such a Zener diode may be provided instead of or in addition to the regulating transistor.

A switching transistor may be electrically coupled in series with the second mirroring transistor in the current shunting path, the power supply may be a current controlled power supply, and the light emitting device may be a first light emitting device. In addition, a controller may be coupled to a control electrode of the switching transistor with the controller being configured to generate a pulse width modulated control signal to vary a current though the current shunting path (e.g., to control a duty cycle of the current through the current shunting path), and a second light emitting device may be electrically coupled in series between the power supply and the reference node. The first and second light emitting devices are electrically coupled in series between the power supply and the reference node, and a sum of electrical currents through the first light emitting device and the current shunting path may be equal to an electrical current through the second light emitting device.

Moreover, the light emitting device may be one of a plurality of light emitting devices electrically coupled in series between the power supply and the first mirroring transistor.

According to still other embodiments of the present invention, a solid state lighting device may include a power supply and a light emitting device electrically coupled between the power supply and a reference node. In addition, a regulating transistor may be provided in a current shunting path between the power supply and the reference node with the current shunting path being electrically coupled in parallel with the light emitting device. Moreover, a control electrode of the regulating transistor may be electrically coupled to a node of the light emitting device.

The light emitting device may be one of a plurality of light emitting devices electrically coupled in series between the power supply and the reference node.

The node may be between two of the plurality of light emitting devices so that the control electrode of the regulating transistor is electrically coupled to the node between the two of the plurality of light emitting devices.

The node between the two of the plurality of light emitting devices may be a first node, a first mirroring transistor may be electrically coupled in series between the plurality of light emitting devices and the reference node, and a second mirroring transistor may be electrically coupled in series with the regulating transistor in the current shunting path. A control electrode of the first mirroring transistor may be electrically coupled to a second node between the plurality of light emitting devices and the first mirroring transistor, and a control electrode of the second mirroring transistor may be electrically coupled to the second node between the plurality of light emitting devices and the first mirroring transistor.

The regulating transistor may be a bipolar junction transistor, and at least one diode may be electrically coupled between the control electrode of the regulating transistor and the first node. More particularly, one or a plurality of such diodes may be used to provide that a voltage drop between the first node and the first mirroring transistor is substantially matched with a voltage drop between the first node and the second mirroring transistor. In other embodiments, the regulating transistor may be a field effect transistor, and a gate to source threshold voltage of the field effect transistor may be substantially matched with a voltage drop between the reference node and the first mirroring transistor.

A switching transistor may be electrically coupled in series with the regulating transistor in the current shunting path between the power supply and the reference node, the power supply may be a current controlled power supply, and the light emitting device may be a first light emitting device. A controller may be coupled to a control electrode of the switching transistor with the controller being configured to generate a pulse width modulated control signal to control a duty cycle of a current though the current shunting path. A second light emitting device may be electrically coupled in series between the power supply and the reference node with the first and second light emitting devices being electrically coupled in series between the power supply and the reference node so that a sum of electrical currents through the first light emitting device and the current shunting path is equal to an electrical current through the second light emitting device.

According to still further embodiments of the present invention, a method may be provided to operate a solid state lighting device including a power supply and a light emitting device electrically coupled between the power supply and a reference node. More particularly, the method may include controlling a voltage drop across a current shunting path responsive to an electrical signal from a node of the light emitting device with the current shunting path being electrically coupled in parallel with the light emitting device between the power supply and the reference node.

The current shunting path may include a regulating transistor and a switch electrically coupled in series, and a pulse width modulated control signal may be provided to a control electrode of the switch to control a pulse width modulated shunt current through the current shunting path to control a duty cycle of the shunt current through the current shunting path. More particularly, controlling the voltage drop may include controlling the regulating transistor responsive to the electrical signal from the node of the light emitting device while providing the pulse width modulated control signal (having a duty cycle between 0% and 100% or between 0 and 1).

The light emitting device may be a first light emitting device and the solid state lighting device may further include a second light emitting device electrically coupled in series with the first light emitting device. In addition, a power supply current may be provided through the second light emitting device with the power supply current being equal to a sum of a current through the first light emitting device and a current through the current shunting path.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

In a solid-state lighting device, electric current is driven through an arrangement of Light Emitting Devices LEDs (e.g., light emitting diodes) to provide a light output. Moreover, current through LEDs of different colors may be adjusted to provide a balance of colors so that a combined/mixed output of the LEDs may appear white. Co-pending and commonly assigned U.S. patent application Ser. No. 12/987,485 (filed Jan. 10, 2011, and entitled "Systems And Methods For Controlling Solid State Lighting Devices And Lighting Apparatus Incorporating Such Systems And/Or Methods") discloses systems and methods to control and/or balance outputs of LEDs to provide a desired output. The disclosure of U.S. application Ser. No. 12/987,485 is hereby incorporated herein in its entirety by reference.

Figure 1:
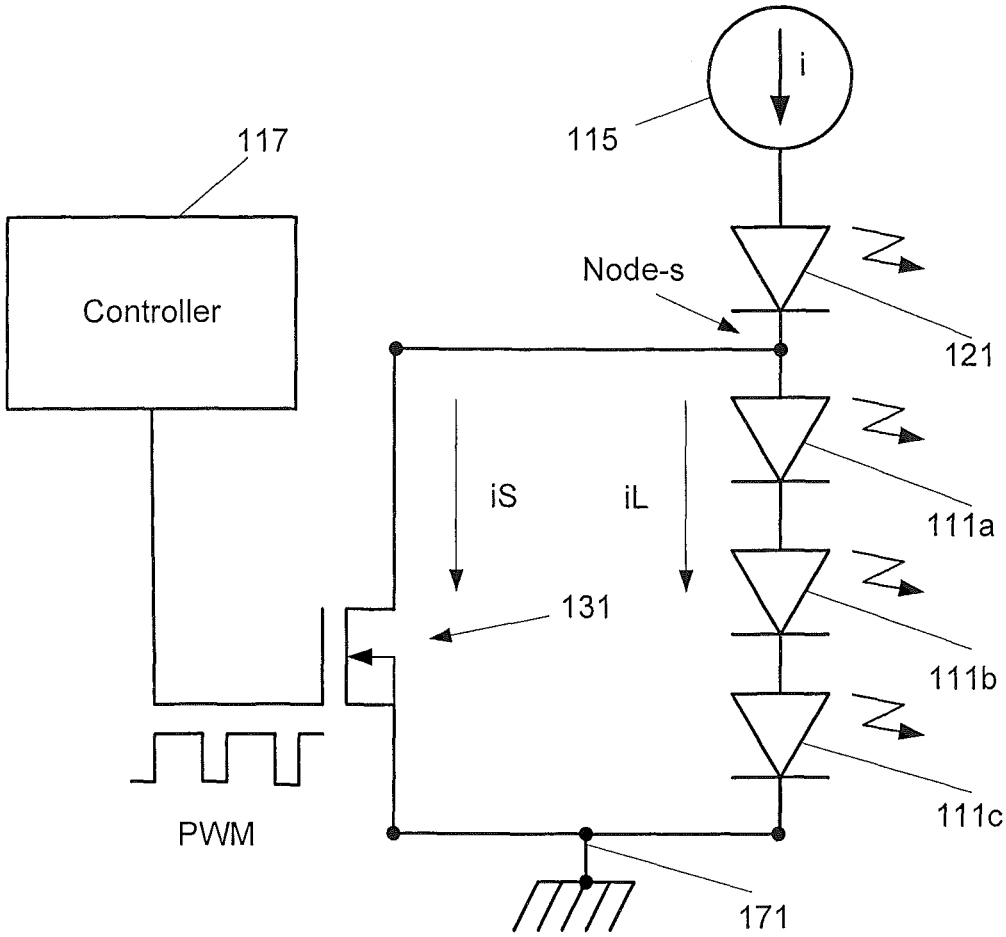
FIGS. 1, 2, 3, 4A, 4B, 4C, 4D, 5, 6, and 7 are schematic circuit diagrams of solid state lighting devices according to some embodiments of the present invention.

As shown in FIG. 1, a string of LEDs (e.g., light emitting diodes) 111*a-c* and 121 may be electrically coupled in series between current controlled power supply 115 and reference node 171 (e.g., ground node). Moreover, LED 121 may generate light of a first color (e.g., blue shifted yellow or BSY), and LEDs 111*a-c* may generate light of a second color (e.g., red) to provide a combined/mixed output that is perceived as being white. Moreover, current controlled power supply 115 may be modeled as an ideal current source to provide a relatively constant current i through LED 121. Because performances of different LEDs of different colors may vary over temperature and/or time and/or because different LEDs of the same color may have different operating characteristics (e.g., due to manufacturing differences/tolerances), a constant current through all of LEDs 111*a-c* and 121 may not provide sufficient control of a resulting combined light output. LEDs 111*a-c* and 121 may thus be electrically coupled in series between current controlled power supply 115 and a reference node 171, such as a ground voltage node, with switch 131 providing a bypass to shunt current around LEDs 111*a-c*. Accordingly, a current iL through LEDs 111*a-c* may be reduced relative to a current i through LED 121 by providing a pulse width modulated (PWM) bypass or shunt current iS (having a duty cycle greater than zero and less than 1) through switch 131 responsive to a pulse width modulation signal (PWM) generated by controller 117.

A desired balance of BSY light output (from LED 121) and red light output (from LEDs 111*a-c*), for example, may be provided by controlling a duty cycle of a shunting current through switch 131 around LEDs 111*a-c*. Switch 131, for example, may be a transistor (e.g., a field effect transistor or FET) having a control electrode (e.g., a gate electrode) electrically coupled to controller 117, and controller 117 may generate a pulse width modulation (PWM) signal that is applied to the control electrode of switch 131 to control a duty cycle of switch 131 and a duty cycle of a shunt current iS through switch 131.

A shunt current iS may thus be diverted from LEDs 111*a-c* through switch 131 to reference node 171 (e.g., ground voltage node) to control a current iL through LEDs 111*a-c* relative to a current i from current controlled power supply 115 that is provided through LED 121. The relatively constant current i generated by current controlled power supply 115 is thus equal to the sum of the currents iL and iS, and the currents iL and iS may be varied by varying a duty cycle of switch 131. By increasing a duty cycle of switch 131 (so that switch 131 remains on for a longer period of time during each PWM cycle), an average of current iS increases and an average of current iL decreases thereby decreasing a light output of LEDs 111*a-c* (and decreasing a power consumed by LEDs 111*a-c*) due to the reduced current iL therethrough. By reducing a duty cycle of switch 131 (so that switch 131 remains off for a longer period of time during each PWM cycle), an average of current iS decreases and an average of current iL increases thereby increasing a light output of LEDs 111*a-c* (and increasing a power consumed by LEDs 111*a-c*) due to the increased current iL therethrough. At 100% duty cycle (i.e., duty cycle or D equal to 1) for switch 131, iS=i, and iL=0 so that LEDs 111*a-c* provide no light output and consume no power. At 0% duty cycle (i.e., duty cycle or D equal to 0) for switch 131, iS=0 and iL=i so that LEDs 111*a-c* provide full light output and consume power that may be calculated as a product of the current i and a voltage drop across transistors 111*a-c*. Of course, a duty cycle of switch 131 may be varied between 0% and 100% (between 0 and 1) to vary a light output of LEDs 111*a-c* (and a power consumed thereby) while maintaining a relatively steady light output from LED 121.

However, the switch 131 may not provide adequate control and/or reliability because capacitances (e.g., resulting from LEDs 121 and/or 111*a-c*) inherent in the device of FIG. 1 may cause sudden changes in voltages along the string of LEDs during PWM switching that may produce significant current spikes through LED 121. These problems may be magnified with increasing numbers of LEDs 111*a-c* coupled in parallel with switch 131 and/or with power supplies having large output capacitances. Stated in other words, a voltage at node-s may transition responsive to each transition of switch 131 between a voltage equal to a sum of the forward voltage drops of LEDs 111*a-c* (when switch 131 is off) and the ground voltage (when switch 131 is on). Moreover, these voltage transitions may occur at the frequency of the pulse width modulation signal applied to switch 131, and these high frequency voltage transitions may cause high frequency current spikes. Using a 60 kHz PWM signal, for example, these voltage transitions and current spikes may occur at a 60 kHz frequency. While a 60 kHz PWM signal is discussed by way of example, any frequency above the flicker fusion threshold may be used, and a lower frequency may reduce electromagnetic interference (EMI) generated by the lighting device. According to some embodiments, the PWM signal may have a frequency in the range of about 1 kHz to about 4 kHz.

Figure 2:
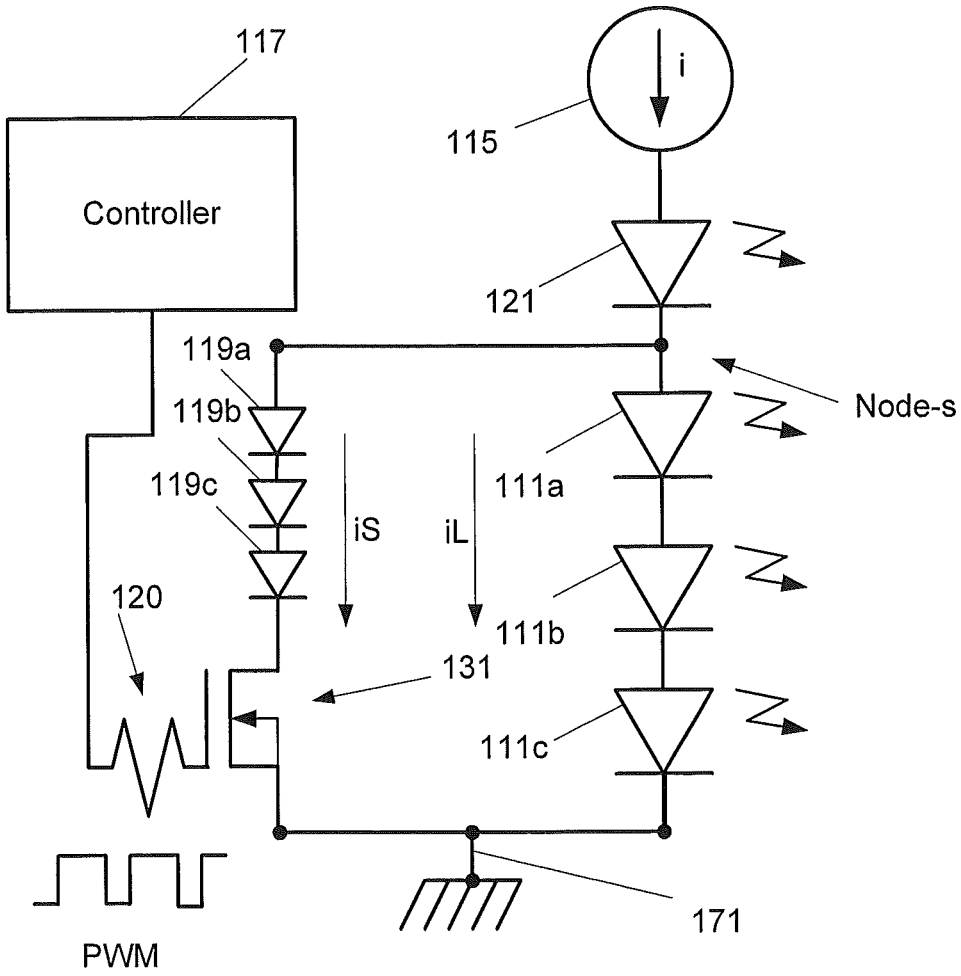

As shown in FIG. 2, regular diodes 119*a-c* (e.g., non-light emitting diodes, also referred to as dark emitting diodes) may be provided in series with switch 131 to reduce changes in voltages experienced by LED 121 when switch 131 is turned on and off. By reducing changes in voltages during switching, a severity of current spikes may be reduced. A perfect matching of voltages may be undesirable, however, because the resulting shunt current iS may not sufficiently reduce the current iL when the switch 131 is turned on. To provide a desired shunting current iS when switch 131 is on, a voltage drop across diodes 119*a-c* may be designed to be less than a voltage drop across shunted LEDs 111*a-c* to provide a desired shunt current iS when switch 131 is turned on. In addition or in an alternative, a resistor 120 may be provided between a control electrode of switch 131 and controller 117 to reduce a slope of transitions between on and off for switch 131 thereby slowing transitions of shunt current iS, slowing transitions of a voltage at node-s, and/or reducing current spikes through non-shunted LEDs.

To maintain more stable currents and/or voltages when switch 131 is turned on and off (to provide pulse width modulation), a total power dissipation resulting from the sum of currents iS and iL may need to remain unchanged. Accordingly, any current iS shunted through switch 131 in the structure of FIG. 2 may need to contribute to a desired total constant power resulting from the sum of currents iS and iL, and any power consumed by shunt current iS may be dissipated/wasted as heat.

Figure 3:
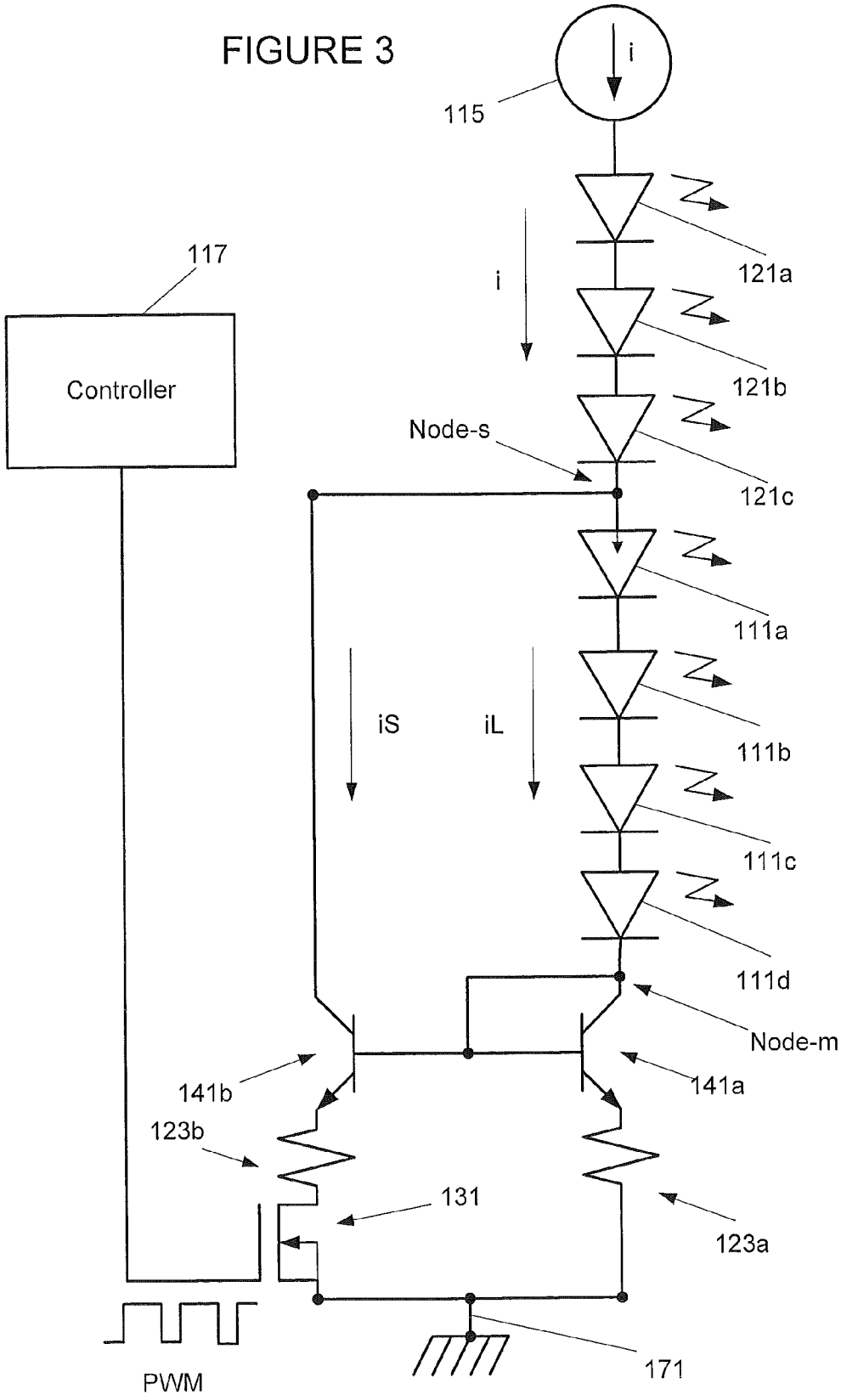

According to some embodiments of the present invention illustrated in FIG. 3, a first plurality of light emitting devices (LEDs) 111*a-d*, a second plurality of light emitting devices 121*a-c*, and mirroring transistor 141*a* may be electrically coupled in series between current controlled power supply 115 (also referred to as a current controlled LED driver that may be modeled as an ideal current source) and reference node 171 (e.g., a ground voltage node). Moreover, switching transistor 131 and second mirroring transistor 141*b* may be electrically coupled in series between a shunting node node-s and reference node 171. In addition, resistor 123*a* may be electrically coupled in series with mirroring transistor 141*a*, LEDs 111*a-d*, and LEDs 121*a-c*, and resistor 123*b* may be electrically coupled in series with mirroring transistor 141*b* and switching transistor 131. By coupling control electrodes of mirroring transistors 141*a* and 141*b* to mirroring node node-m, mirroring transistors 141*a* and 141*b* may provide a current mirror structure used to control shunting current iS when switch 131 is on during PWM cycles.

Controller 117 may be coupled to a control electrode of PWM switch 131 (e.g., a switching transistor such as a field effect transistor), and controller 117 may be configured to generate a pulse width modulation PWM control signal to control a current iS (e.g., to control a duty cycle of shunt current iS) through the shunting path from node-s through mirroring transistor 141*b*, resistor 123*b*, and switching transistor 131 to reference node 171. More particularly, a duty cycle of current iS through the shunting path may be varied responsive to a duty cycle of the PWM control signal generated by controller 117. A sum of current iL through shunted LEDs 111*a-d* and current iS through switch 131 is thus equal to current i generated by power supply 115 that is provided though LEDs 121*a-c*. With a duty cycle of 0% (i.e., duty cycle or D equal to 0) for current iS (as determined by a duty cycle of the PWM control signal generated by controller), for example, iS=0 and iL=i, so that the current through LEDs 111*a-d* and 121*a-c* is the same. If the duty cycle of current iS increases, an average of current iS increases and an average of current iL through LEDs 111*a-d* decreases while the current i through LEDs 121*a-c* remains substantially unchanged. Accordingly, different duty cycles of current iS can be used to adjust an output of LEDs 111*a-d* relative to an output of LEDs 121*a-c*.

By providing the current mirror structure including mirroring transistors 141*a* and 141*b*, a magnitude of current iS shunted around transistors 111*a-d* may be controlled when switch 131 is turned on so that a relatively low current iL is maintained through shunted LEDs 111*a-d* even when switch 131 is turned on. By leaving shunted LEDs 111*a-d* slightly on (i.e., iL>0) when switch 131 is turned on, a voltage at node-s may remain relatively constant even though current iS is switching on and off at a relatively high frequency (responsive to the PWM control signal from controller 117). Stated in other words, current iL may be reduced by switching current iS on and off so that a voltage across LEDs 111*a-d* remains relatively constant (as determined by a sum of voltage drops of LEDs 111*a-d*), and current spikes through LEDs 121*a-c* due to switching of current iS may be significantly reduced.

Considering practical currents iS in the structure of FIG. 3, however, mirroring transistor 141*b* (on a shunting side of the mirror structure) may be required to dissipate more power when switch 131 is on than mirroring transistor 141*a* (on a control side of the mirror structure). A junction of mirroring transistor 141*b* may thus be heated to a higher temperature than a junction of mirroring transistor 141*a* creating an imbalance in the mirror structure. Stated in other words, mirroring transistor 141*b* of FIG. 3 may be required to dissipate power to maintain a constant voltage at shunting node node-s, and the resulting heat may cause an imbalance in the mirror structure reducing performance thereof.

Figure 4A:
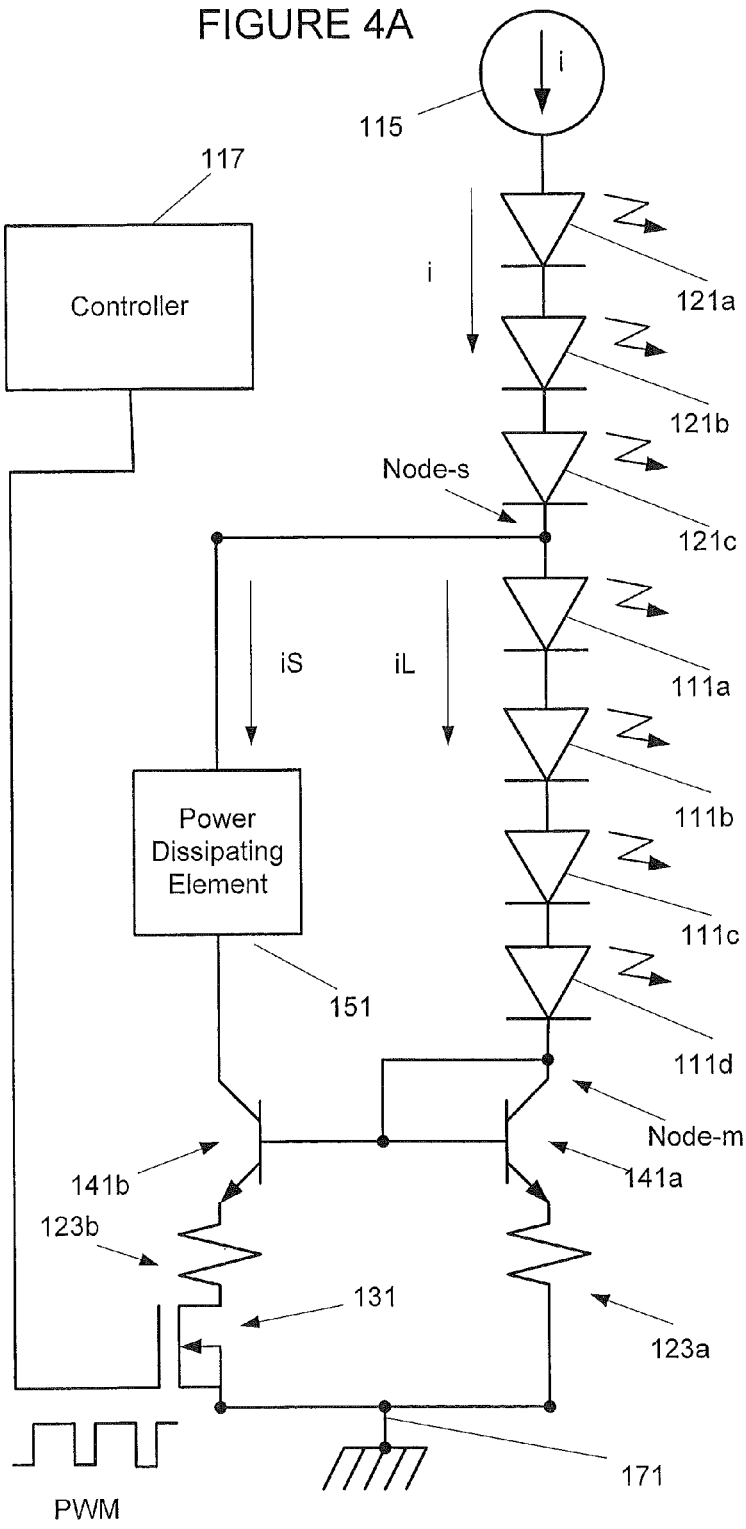
Figure 4B:
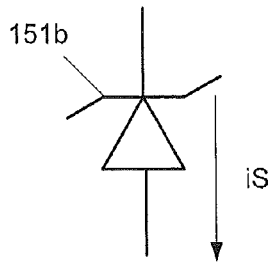
Figure 4C:
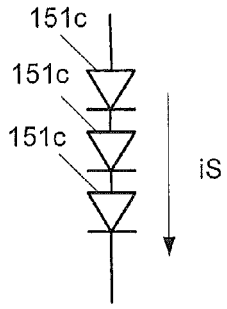
Figure 4D:
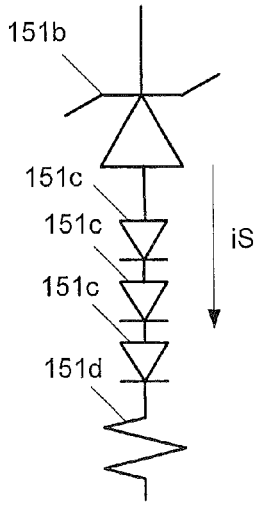

As shown in FIG. 4A, a power dissipating element 151 (such as a reverse biased Zener diode 151*b* as shown in FIG. 4B, a plurality of serially coupled regular diodes 151*c* as shown in FIG. 4C, and/or a combination thereof as shown in FIG. 4D) may be electrically coupled in series with switch 131 and mirroring transistor 141*b* between switching node node-s and reference node 171. Using Zener diode 151*b* of FIG. 4B as the power dissipating element 151, a breakdown voltage (also referred to as a Zener voltage) of Zener diode 151*b* may be matched with a sum of the forward voltage drops of shunted LEDs 111*a-d* to maintain a relatively constant voltage at switching node node-s while reducing power dissipated at mirroring transistor 141*b*. Power may thus be dissipated at Zener diode 151*b* to maintain a relatively constant voltage at shunting node node-s.

Using Zener diode 151*b*, a breakdown voltage of Zener diode 171 may be matched as closely as possible with a sum of forward voltage drops of shunted LEDs 111*a-d* without exceeding the sum of forward voltage drops of shunted LEDs 111*a-d*. If a breakdown voltage of Zener diode 171 is too high (i.e., the breakdown voltage exceeds the sum of the forward voltage drops of the shunted LEDs), control may be lost because the current i will follow the path iL when switch 131 is on due to the lower voltage path provided through LEDs 111*a-d*. If a breakdown voltage of Zener diode 151*b* is too low, too much power may be dissipated through mirroring transistor 131.

Zener diode 151*b*, however, may have a much sharper knee in its V-I curve than LEDs 111*a-d* (taken alone or in combination). Accordingly, a mis-match between a breakdown voltage of Zener diode 151*b* and forward voltage drops of LEDs 111*a-d* may occur when current iL is reduced (e.g., during dimming operation) so that a forward voltage drop across LEDs 111*a-d* is less than the previously matched breakdown voltage of Zener diode 151*b*. Accordingly, it may be difficult to maintain control of current iL over a full range of desired operating currents i. Moreover, it may be difficult to provide a Zener diode capable of handling the power dissipation.

As noted above, power dissipating element 151 may be implemented as a string of regular diodes (also referred to as non-light emitting diodes or dark emitting diodes) 151*c* serially coupled between switching node node-s and mirroring transistor 141*b*. Here a sum of forward voltage drops across diodes 151*c* may be matched with a sum of forward voltage drops across LEDs 111*a-d*. For example, each of four serially coupled LEDs 111*a-d* may have a forward voltage drop of about 2.2 volts so that the string of four LEDs 111*a-d* has a forward voltage drop of about 8.8 volts. If each regular diode 151*c* has a forward voltage drop of about 0.7 volts, 12 of such regular diodes may be provided in power dissipating element 151 to provide a combined voltage drop of about 8.4 volts (substantially matching without exceeding the 8.8 volt drop across four LEDs 111*a-d*). Moreover, V-I characteristics of such regular diodes may be relatively closely matched to V-I characteristics of LEDs 111*a-d*, but 12 such diodes may require an excessive amount of space.

As shown in FIG. 4D, a combination of Zener diode 151*b*, regular diodes 151*c*, and/or resistor 151*d* may be provided for power dissipating element 151 to address issues noted above with respect to Zener and regular diodes. While a serial coupling is illustrated in FIG. 4D, other couplings (e.g., in parallel) may be provided to achieve desired voltage/current characteristics. Such arrangements, however, may require redesign for each different LED arrangement, and even then, the desired V-I curve may only be approximated.

As discussed above with respect to FIGS. 3 and 4A, mirroring transistor 141*b* may be controlled responsive to a voltage at node-m between shunted LEDs 111*a-d* and mirroring transistor 141*a*. Mirroring transistor 141*b* may thus control a shunting current iS through switch 131 when switch 131 is on, and/or mirroring transistor 141*b* may also control a voltage at shunting node node-s between shunted LEDs 111*a-d* and non-shunted transistors 121*a-c*. Accordingly, mirroring transistor 141*b* may be referred to as a regulating transistor having a control electrode thereof electrically coupled to a node (e.g., node-m) of one of the LEDs (e.g., LED 111*d*), so that a voltage drop across the current shunting path (from shunting node node-s through switch 131 to reference node 171) is controllable responsive to an electrical signal (e.g., a voltage) from a node of one of shunted LEDs 111*a-d* (e.g., LED 111*d*).

Figure 5:
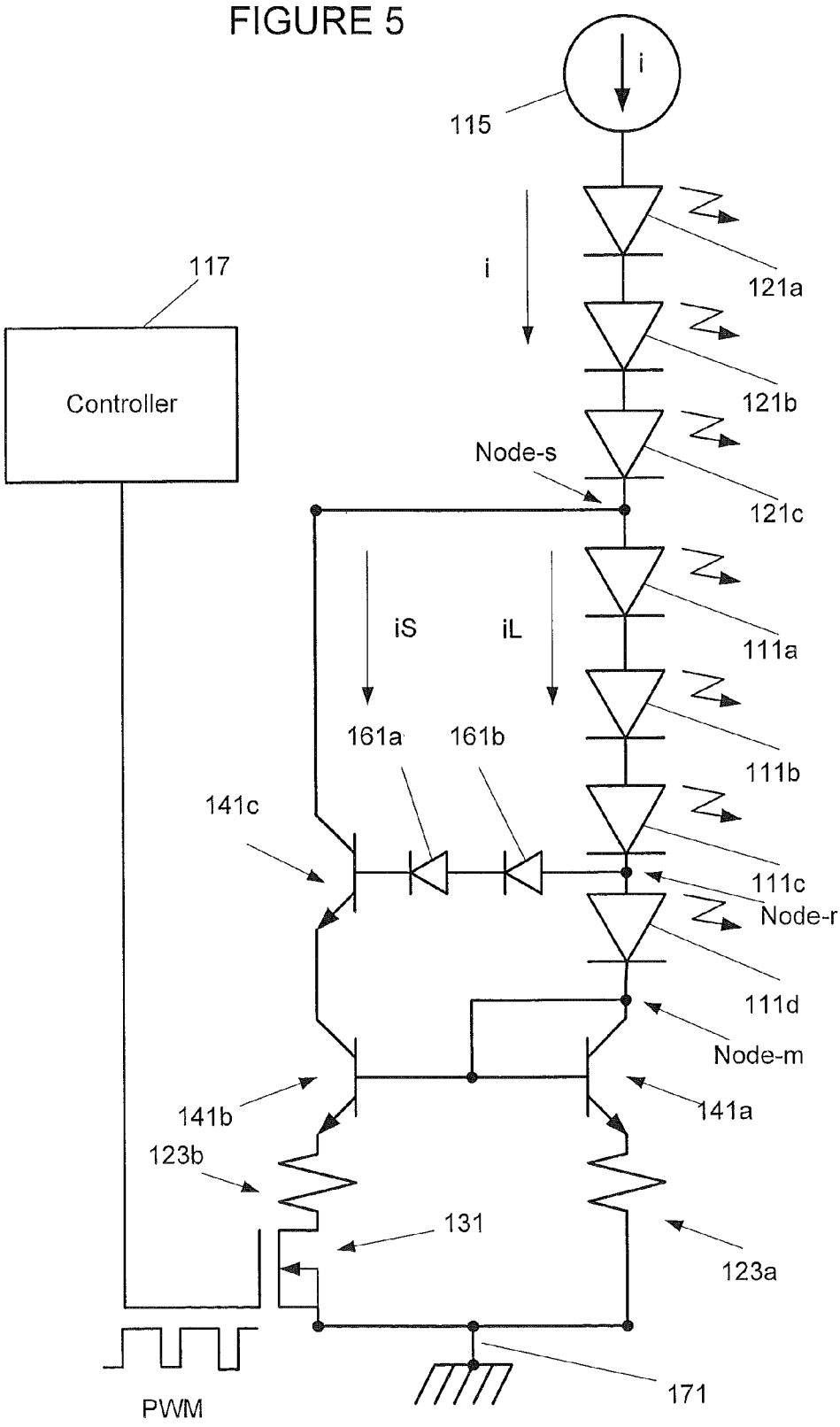

According to some embodiments illustrated in FIG. 5, mirroring transistors 141*a* and 141*b*, shunted LEDs 111*a-d*, non-shunted LEDs 121*a-c*, switch 131, power supply 115, and controller 117 may be provided as discussed above with respect to FIGS. 3 and 4A. In addition, regulating transistor 141*c* may be provided as a power dissipating element between mirroring transistor 141*b* and shunting node node-s, and a control electrode of regulating transistor 141*c* may be electrically coupled to a regulating node node-r between two of the shunted LEDs 111*a-d*. A voltage drop across the current shunting path between shunting node node-s and reference node 171 (through regulating transistor 141*c*, mirroring transistor 141*b*, resistor 123*b*, and switch 131) may thus be controllable responsive to an electrical signal (e.g., voltage) at regulating node node-r between shunted LEDs 111*c* and 111*d*. If a voltage at shunting node node-s drops too far, for example, a voltage at regulating node node-r will drop thereby reducing an electrical signal (current/voltage) at a control electrode of regulating transistor 141*c* thereby reducing shunt current iS therethrough and increasing the voltage at shunting node node-s. Conversely, if a voltage at shunting node node-s rises too high, a voltage at regulating node node-r will rise thereby increasing an electrical signal (current/voltage) at a control electrode of regulating transistor 141*c* thereby increasing a shunt current iS therethrough and reducing the voltage at shunting node node-s. Regulating transistor 141*c* may thus be configured to regulate a voltage at shunting node node-s and to also dissipate power required to provide such regulation.

According to some embodiments, regulating transistor 141*c* may be an NPN bipolar junction transistor having its base (e.g., control electrode) electrically coupled to regulating node node-r. In addition, one or a plurality of regular (e.g., non-light emitting or dark emitting) diodes 161*a-b* may be electrically coupled in series between regulating node node-r and the base (or control electrode) of regulating transistor 141*c*. More particularly, diodes 161*a-b* may be provided to match a voltage drop from regulating node node-r to mirroring transistor 141*b* (through diodes 161*a-b* and transistor 141*c*) to a voltage drop from regulating node node-r to mirroring transistor 141*a* (e.g., through LED 111*d*). If LED 111*d* has a forward voltage drop of 2.2 volts, each of regular diodes 116*a-b* has a forward voltage drop of 0.7 volts, and transistor 141*c* has a base to emitter voltage drop of 0.7 volts, a voltage drop of 2.1 volts from regulating node node-r to mirroring transistor 141*b* may be substantially matched with a voltage drop of 2.2 volts from regulating node node-r to mirroring transistor 141*a*. Accordingly, regulating node node-r may be provided between LEDs 111*b-c* or between LEDs 111*a-b* with different numbers of diodes 161*a-b* used to provide appropriate voltage matching. A voltage drop from node-r to an emitter of regulating transistor 141*c* (between regulating transistor 141*c* and mirroring transistor 141*b*), for example, may be configured (e.g., by adding diodes 161) to be at least 70% of a sum of forward voltage drops of all shunted LEDs 111 between node-r and reference node 171, at least 85% of a sum of forward voltage drops of all shunted LEDs 111 between node-r and reference node 171, or even at least 95% of a sum of forward voltage drops of all shunted LEDs 111 between node-r and reference node 171.

Figure 6:
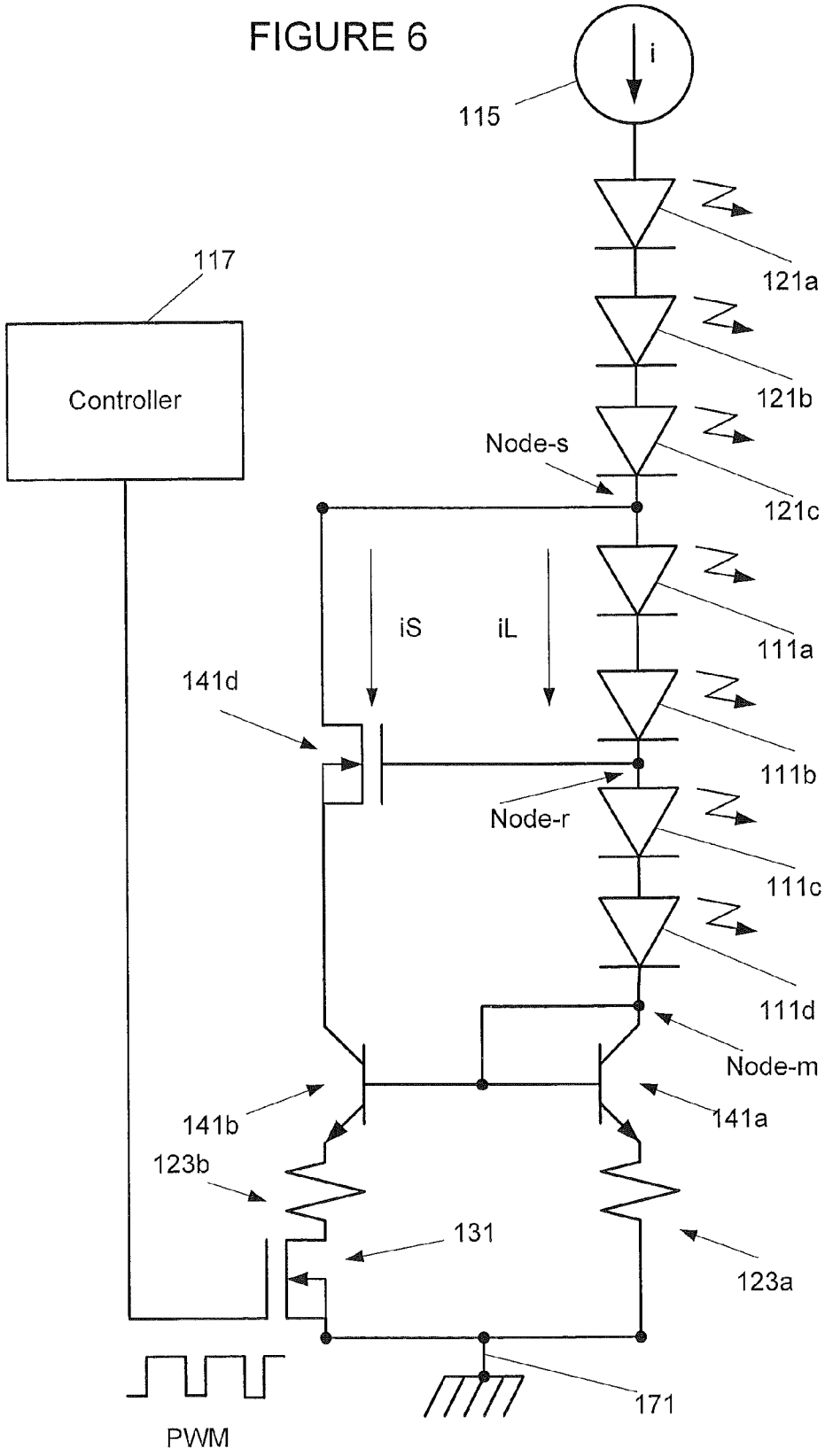

According to some embodiments illustrated in FIG. 6, a field effect transistor (FET) 141*d* may be provided as a power dissipating element between mirroring transistor 141*b* and shunting node node-s, and a control electrode or gate of regulating transistor 141*c* may be electrically coupled to a regulating node node-r between two of the shunted LEDs 111*a-d*. Mirroring transistors 141*a* and 141*b*, shunted LEDs 111*a-d*, non-shunted LEDs 121*a-c*, switch 131, power supply 115, and controller 117 may be provided as discussed above with respect to FIGS. 3, 4A, and 5.

A voltage drop across the current shunting path between shunting node node-s and reference node 171 (through regulating transistor 141*d*, mirroring transistor 141*b*, resistor 123*b*, and switch 131) may thus be controllable responsive to an electrical signal (e.g., voltage) at regulating node node-r between shunted LEDs 111*b* and 111*c*. If a voltage at shunting node node-s drops too far, for example, a voltage at regulating node node-r will drop thereby reducing an electrical signal (voltage) at a gate of field effect transistor 141*d* thereby reducing shunt current iS therethrough and increasing the voltage at shunting node node-s. Conversely, if a voltage at shunting node node-s rises too high, a voltage at regulating node node-r will rise thereby increasing an electrical signal (voltage) at a gate of regulating field effect transistor 141*d* thereby increasing a shunt current iS therethrough and reducing the voltage at shunting node node-s.

Regulating field effect transistor 141*d* may thus be configured to regulate a voltage at shunting node node-s and to also dissipate power required to provide such regulation. Moreover field effect transistor 141*d* may be configured to provide that a voltage drop from regulating node node-r to mirroring transistor 141*b* (through FET 141*d*) is matched with a voltage drop from regulating node node-r to mirroring transistor 141*a* (through LEDs 111*c-d*). More particularly, FET 141*d* may be configured to provide a gate to source threshold voltage that is substantially equal to a voltage drop across LEDs 111*c-d*. If LEDs 111*c-d* have a combined forward voltage drop of 4.4 volts, FET 141*d* may be configured to provide a gate to source threshold voltage of about 4.4 volts. A different gate to source threshold voltage of FET 141*d* may be provided, for example, if regulating node node-r is provided between LEDs 111*c-d* or between LEDs 111*a-b*. A gate to source threshold voltage of FET 141*d*, for example, may be configured to be at least 70% of a sum of forward voltage drops of all shunted LEDs 111 between node-r and reference node 171, at least 85% of a sum of forward voltage drops of all shunted LEDs 111 between node-r and reference node 171, or even at least 95% of a sum of forward voltage drops of all shunted LEDs 111 between node-r and reference node 171.

As discussed above with respect to FIGS. 5 and 6, mirroring transistor 141*b* and a regulating transistor (e.g., regulating transistor 141*c* or 141*d*) may be electrically coupled in series with switch 131 between reference node 171 and shunting node node-s to regulate shunt current iS and/or a voltage at node-s, and both transistors may be controllable responsive to electrical signals from respective nodes of shunted LEDs 111*a-d*. Accordingly, each of mirroring transistor 141*b* and regulating transistor 141*c* or 141*d* may be referred to as regulating transistors. In FIG. 5, for example, mirroring transistor 141*b* may be referred to as a first regulating transistor, and regulating transistor 141*c* may be referred to as a second regulating transistor. Similarly, in FIG. 6, mirroring transistor 141*b* may be referred to as a first regulating transistor, and regulating field effect transistor 141*d* may be referred to as a second regulating transistor.

In embodiments illustrated in FIGS. 5-6, the current mirror including mirroring transistors 141*a* and 141*b* may control an amount of shunt current, and a regulating transistor 141*c* or 141*d* may be configured to match its voltage to that of the shunted LEDs 111*a-d*. Accordingly, regulating transistor 141*c* and/or 141*d* may be configured to dissipate power as needed to regulate a voltage at shunting node node-s to thereby reduce current spikes through non-shunted LEDs 121*a-c* when switching shunt current iS at a duty cycle greater than zero and less than one.

Figure 7:
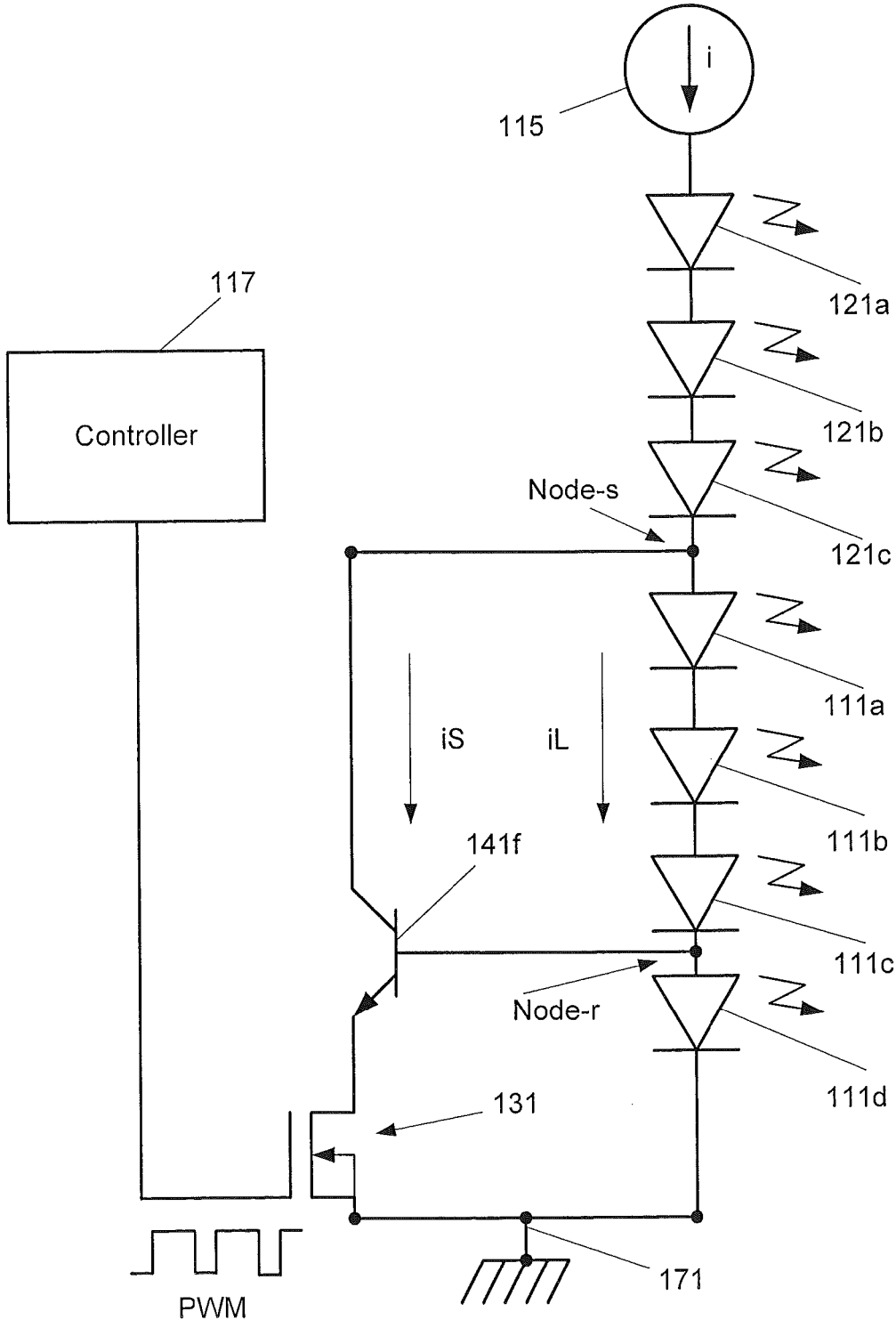
Figure 8:
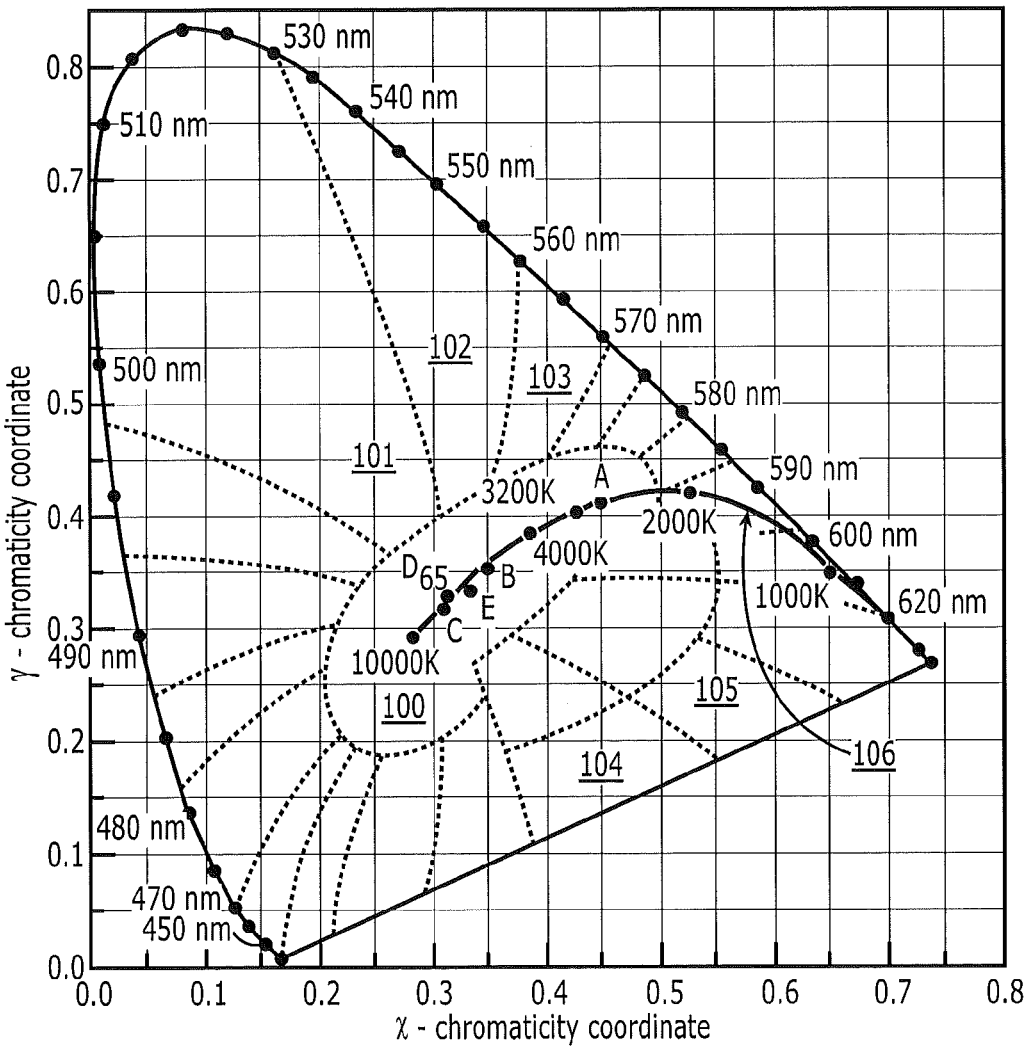
FIG. 8 illustrates a 1931 CIE chromaticity diagram.

According to further embodiments illustrated in FIG. 7, regulating transistor 141*f* may be provided without a current mirror structure. Stated in other words, non-shunted LEDs 121*a-c*, shunted LEDs 111*a-d*, power supply 115, controller 115, and switch 131 may be provided as discussed above with respect to FIGS. 5 and 6, but the current mirror structure (including mirroring transistors 141*a-b* and resistors 123*a-b*) may be omitted. Regulating transistor 141*f* and switch 131 may thus be electrically coupled in series between shunting node node-s and reference node 171 to control shunt current iS and/or a voltage at node-s. More particularly, regulating transistor 141*f* may be configured to regulate shunt current iS and/or a voltage at node-s responsive to an electrical signal from node-r between LEDs 111*c* and 111*d* when switch 131 is on. Regulating transistor 141*f* may thus dissipate power as needed to regulate a voltage at shunting node node-s to thereby reduce current spikes through non-shunted LEDs 121*a-c*.

As shown in FIG. 7, regulating transistor 141*f* may be an NPN bipolar junction transistor with a base (control electrode) electrically coupled to node-r. While not shown in FIG. 7, one or more regular diodes may be electrically coupled in series between node-r and the base of regulating transistor 141*f* (implemented as an NPN bipolar junction transistor) to match a voltage drop from node-r through regulating transistor 141*f* and switch 131 to reference node 171 with a voltage drop from node-r through LED 111*d* to reference node 171. With two such diodes (arranged as shown by diodes 161*a* and 161*b* of FIG. 5) having a forward voltage drop of about 0.7 volts each, with regulating transistor 141*f* having a base to emitter voltage drop of about 0.7 volts, and with LED 111*d* having a forward voltage drop of about 2.2 volts, a combined voltage drop of about 2.1 volts through the diodes and regulating transistor 141*f* may be substantially matched with a forward voltage drop of about 2.2 volts through LED 111*d*. With an NPN bipolar junction transistor provided as regulating transistor 141*f*, node-r may be moved to another node between shunted LEDs (e.g., between LEDs 111*b* and 111*c* or between LEDs 111*a* and 111*b*) with additional diodes used to provide voltage matching. As discussed above with respect to FIG. 5, a voltage drop from node-r to an emitter of regulating transistor 141*f* (between regulating transistor 141*f* and switching transistor 131), for example, may be configured (e.g., by adding diodes 161) to be at least 70% of a sum of forward voltage drops of all shunted LEDs 111 between node-r and reference node 171, at least 85% of a sum of forward voltage drops of all shunted LEDs 111 between node-r and reference node 171, or even at least 95% of a sum of forward voltage drops of all shunted LEDs 111 between node-r and reference node 171.

According to other embodiments, regulating transistor 141*f* may be implemented as a field effect transistor (arranged as shown by field effect transistor 141*d* of FIG. 6). As discussed above with respect to FIG. 6, such a field effect transistor may be configured to provide that a gate to source threshold voltage of the FET is substantially matched with a voltage drop from node-r through one or more of shunted LEDs 111*a-d* between node-r and reference node 171. Using a field effect transistor for regulating transistor 141*f* with node-r provided between LEDs 111*b* and 111*c* so that a gate of the field effect transistor is coupled between LEDs 111*b* and 111*c*, a gate to source threshold voltage may be substantially matched with a sum of forward voltage drops through LEDs 111*c* and 111*d*. With a field effect transistor provided as regulating transistor 141*f*, node-r may be moved to another node between shunted LEDs (e.g., between LEDs 111*c* and 111*d* or between LEDs 111*a* and 111*b*) with different gate to source threshold voltages used to provide voltage matching based on a number of LEDs between node-r and reference node 171. A gate to source threshold voltage of such a FET, for example, may be configured to be at least 70% of a sum of forward voltage drops of all shunted LEDs 111 between node-r and reference node 171, at least 85% of a sum of forward voltage drops of all shunted LEDs 111 between node-r and reference node 171, or even at least 95% of a sum of forward voltage drops of all shunted LEDs 111 between node-r and reference node 171.

Moreover, controller 117 may be implemented without need for closed loop feedback. A relatively cheap microcontroller and/or other PWM generator may thus be used to precisely control switch 131 and shunt current iS.

Required PWM duty cycles for respective sets of conditions (e.g., target color point, temperature, current iL through LEDs 111*a-d*, current i through LEDs 121*a-c*, etc.) can be modeled using techniques similar to those described in U.S. application Ser. No. 12/987,485 (referenced above), and the duty cycles may be programmed in controller 117 for the modeled conditions. At a given set of conditions, controller 117 may generate a respective constant duty cycle PWM signal, and regulating transistors discussed above may provide that a voltage at shunt node node-s is relatively constant (while switching shunt current iS according to the PWM duty cycle). Controller 117, for example, may change a duty cycle of the PWM signal responsive to changes in temperature of LEDs 121*a-c* and/or 111*a-d* (using input from a temperature sensor), responsive to changes in current i generated by current controlled power supply 115 (responsive to a dimmer input signal), etc.

Accordingly, controller 117 may be configured to provide a target color point and/or to provide lumen output control (e.g., dimmer control). If shunted LEDs 111*a-d* generate light having a first color (e.g., red) and un-shunted LEDs 121*a-c* generate light having a second color (e.g., BSY), controller 117 and/or switch 131 may be configured to reduce the current iL through shunted LEDs 111*a-d* relative to the current i through un-shunted LEDs 121*a-c* to provide a desired color output for the lighting apparatus. Such control may be used to compensate for different characteristics (e.g., due to manufacturing variations) of different LEDs used in different devices and/or to compensate for different characteristics of transistors at different operating temperatures. If shunted LEDs 111*a-d* and un-shunted LEDs 121*a-c* generate light having a same/similar color/colors, controller 117 may be configured to provide lumen output control (e.g., dimmer control).

While three un-shunted LEDs 121*a-c* and four shunted LEDs 111*a-d* are shown in FIGS. 3, 4A, 5, 6, and 7 by way of example, other numbers of LEDs may be used. Moreover, relative placements of elements may be varied without changing the functionality thereof. Un-shunted LEDs 121*a-c*, for example, may be provided between reference node 171 (e.g., a ground node) and a second reference node (e.g., a negative voltage node). Moreover, un-shunted LEDs may be provided between current controlled power supply 115 and shunt node node-s and between ground voltage node and a negative voltage node.

Embodiments of the present invention may thus provide systems and methods to control solid state lighting devices and lighting apparatus incorporating such systems and/or methods. Some embodiments of the present invention may be used in connection with and/or in place of bypass compensation circuits as described, for example, in co-pending and commonly assigned U.S. patent application Ser. No. 12/566,195 entitled "Solid State Lighting Apparatus with Controllable Bypass Circuits and Methods of Operating Thereof" published as U.S. Publication No. 2011/0068702 and co-pending and commonly assigned U.S. patent application Ser. No. 12/566,142 entitled "Solid State Lighting Apparatus with Configurable Shunts" published as U.S. Publication No. 2011/0068696. The disclosures both of the above referenced publications are incorporated herein by reference.

According to some embodiments, an output of a solid state lighting device may be modeled based on one or more variables, such as current, temperature and/or LED bins (brightness and/or color bins) used, and the level of current shunting employed, and this modeling may be used to program controller 117 on a device by device basis. The model may thus be adjusted for variations in individual solid state lighting devices.

According to embodiments of the present invention discussed above, controller 117 and switch 131 may use a pulse width modulated shunt current iS (also referred to as a switched shunt current) to provide a reduced average electrical current iL through light emitting devices 111*a-d* while maintaining a substantially constant voltage at shunt node node-s. At a given duty cycle of pulse width modulated shunt current iS, for example, power dissipating elements, regulating transistors, and/or mirroring transistors discussed above may be configured to maintain a steady voltage at shunt node node-s (across the current shunting path) within 30% of an average of the steady voltage at shunt node node-s and to maintain a steady current i through non-shunted LEDs 121*a-c* within 30% of an average of the current i through non-shunted LEDs 121*a-c*. More particularly, power dissipating elements, regulating transistors, and/or mirroring transistors discussed above may be configured to maintain a steady voltage at shunt node node-s (across the current shunting path) within 15% or even 5% of the average of the steady voltage at shunt node node-s and to maintain a steady current i through non-shunted LEDs 121*a-c* within 15% or even 5% of an average of the current i through non-shunted LEDs 121*a-c*. Accordingly, a pulse width modulated shunt current iS may be used to control an output of shunted LEDs 111*a-d* while maintaining a substantially steady current through non-shunted LEDs 121*a-c*. Improved power efficiency, reliability, and/or control may thus be achieved.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A device comprising:

a power supply;

a light emitting device electrically coupled between the power supply and a reference node, wherein the light emitting device defines a node;

a control element in a current shunting path electrically coupled in parallel with the light emitting device between the power supply and the reference node, wherein the control element is configured to control a voltage drop across the current shunting path responsive to an electrical signal from the node of the light emitting device, wherein the control element comprises a regulating transistor and wherein a control electrode of the regulating transistor is electrically coupled to the node of the light emitting device;

a switching transistor electrically coupled in series with the regulating transistor in the current shunting path between the power supply and the reference node; and a controller coupled to a control electrode of the switching transistor, wherein the controller is configured to generate a pulse width modulated control signal that is applied to the control electrode of the switching transistor to vary a current though the current shunting path.

2. The device according to claim 1 further comprising:

a mirroring transistor electrically coupled in series between the light emitting device and the reference node, wherein a control electrode of the mirroring transistor is electrically coupled to the control electrode of the regulating transistor, wherein the node of the light emitting device is between the light emitting device and the mirroring transistor so that the control electrodes of the regulating transistor and the mirroring transistor are electrically coupled to the node between the light emitting device and the mirroring transistor.

3. A device comprising:

a power supply;

a light emitting device electrically coupled between the power supply and a reference node, wherein the light emitting device defines a node;

a control element in a current shunting path electrically coupled in parallel with the light emitting device between the power supply and the reference node, wherein the control element is configured to control a voltage drop across the current shunting path responsive to an electrical signal from the node of the light emitting device, wherein the control element comprises a regulating transistor, and wherein a control electrode of the regulating transistor is electrically coupled to the node of the light emitting device;

a switching transistor electrically coupled in series with the regulating transistor in the current shunting path between the power supply and the reference node;

a mirroring transistor electrically coupled in series between the light emitting device and the reference node, wherein a control electrode of the mirroring transistor is electrically coupled to the control electrode of the regulating transistor, wherein the node of the light emitting device is between the light emitting device and the mirroring transistor so that the control electrodes of the regulating transistor and the mirroring transistor are electrically coupled to the node between the light emitting device and the mirroring transistor, wherein the light emitting device comprises a plurality of light emitting devices electrically coupled in series between the power supply and the mirroring transistor, wherein the node between the light emitting device and the mirroring transistor comprises a first node between the plurality of light emitting devices and the mirroring transistor, wherein the regulating transistor comprises a first regulating transistor; and a second regulating transistor electrically coupled in series in the current shunting path between the first regulating transistor and the power supply, wherein a control electrode of the second regulating transistor is electrically coupled to a second node between two of the plurality of light emitting devices.

4. The device according to claim 3 wherein the second regulating transistor comprises a bipolar junction transistor, and wherein the control electrode of the second regulating transistor comprises a base of the bipolar junction transistor, the solid state lighting device further comprising:

at least one diode electrically coupled between the base of the bipolar junction transistor and the second node.

5. The device according to claim 3 wherein the second regulating transistor comprises a field effect transistor, wherein the control electrode of the second regulating transistor comprises a gate field effect transistor, and wherein the gate of the field effect transistor is electrically coupled to the second node.

6. The device according to claim 2 further comprising:

a reverse biased Zener diode electrically coupled in series in the current shunting path between the regulating transistor and the power supply.

7. A device comprising:

a power supply;

a light emitting device electrically coupled between the power supply and a reference node, wherein the light emitting device defines a node wherein the light emitting device comprises a plurality of light emitting devices electrically coupled in series between the power supply and the reference node, and wherein the node is between two of the plurality of light emitting devices;

a control element in a current shunting path electrically coupled in parallel with the light emitting device between the power supply and the reference node, wherein the control element is configured to control a voltage drop across the current shunting path responsive to an electrical signal from the node of the light emitting device, wherein the control element comprises a regulating transistor and wherein a control electrode of the regulating transistor is electrically coupled to the node of the light emitting device, and wherein the control electrode of the regulating transistor is electrically coupled to the node between the two of the plurality of light emitting devices; and a switching transistor electrically coupled in series with the regulating transistor in the current shunting path between the power supply and the reference node.

8. The device according to claim 1 wherein the power supply comprises a current controlled power supply, and wherein the light emitting device comprises a first light emitting device, the solid state lighting device further comprising:

a second light emitting device electrically coupled between the power supply and the reference node, wherein the first and second light emitting devices are electrically coupled in series between the power supply and the reference node, and wherein a sum of electrical currents through the first light emitting device and the current shunting path is equal to an electrical current through the second light emitting device.

9. The device according to claim 1 wherein the light emitting device comprises a plurality of light emitting devices electrically coupled in series between the power supply and the reference node.

10. A device comprising:

a power supply;

a light emitting device electrically coupled between the power supply and a reference node;

a first mirroring transistor electrically coupled between the light emitting device and the reference node wherein a control electrode of the first mirroring transistor is electrically coupled to a node between the light emitting device and the first mirroring transistor wherein the light emitting device comprises a plurality of light emitting devices electrically coupled in series between the power supply and the first mirroring transistor, and wherein the node between the light emitting device and the first mirroring transistor comprises a first node between the plurality of light emitting devices and the first mirroring transistor;

a second mirroring transistor in a current shunting path between the power supply and the reference node wherein the current shunting path is electrically coupled in parallel with the light emitting device, and wherein a control electrode of the second mirroring transistor is electrically coupled to the node between the light emitting device and the first mirroring transistor; and a regulating transistor electrically coupled in series with the second mirroring transistor in the current shunting path between the second mirroring transistor and the power supply, and wherein a control electrode of the regulating transistor is electrically coupled to a second node between two of the plurality of light emitting devices.

11. The device according to claim 10 wherein the regulating transistor comprises a bipolar junction transistor, and wherein the control electrode of the regulating transistor comprises a base of the bipolar junction transistor, the solid state lighting device further comprising:

at least one diode electrically coupled between the base of the bipolar junction transistor and the second node.

12. The device according to claim 10 wherein the regulating transistor comprises a field effect transistor, wherein the control electrode of the regulating transistor comprises a gate of the field effect transistor, and wherein the gate of the field effect transistor is electrically coupled to the second node.

13. A device comprising:

a power supply;

a light emitting diode electrically coupled between the power supply and a reference node;

a first mirroring transistor electrically coupled between the light emitting diode and the reference node wherein a control electrode of the first mirroring transistor is electrically coupled to a node between the light emitting diode and the first mirroring transistor, wherein a cathode of the light emitting diode is electrically coupled between an anode of the light emitting diode and the first mirroring transistor, and wherein the cathode of the light emitting diode is electrically coupled between the anode of the light emitting diode and the node between the light emitting diode and the first mirroring transistor;

a second mirroring transistor in a current shunting path between the power supply and the reference node wherein the current shunting path is electrically coupled in parallel with the light emitting diode, and wherein a control electrode of the second mirroring transistor is electrically coupled to the node between the light emitting diode and the first mirroring transistor; and a Zener diode electrically coupled in series with the second mirroring transistor in the current shunting path, wherein the Zener diode is electrically coupled between the second mirroring transistor and the power supply.

14. A device comprising:

a power supply;

a light emitting device electrically coupled between the power supply and a reference node;

a first mirroring transistor electrically coupled between the light emitting device and the reference node wherein a control electrode of the first mirroring transistor is electrically coupled to a node between the light emitting device and the first mirroring transistor;

a second mirroring transistor in a current shunting path between the power supply and the reference node wherein the current shunting path is electrically coupled in parallel with the light emitting device, and wherein a control electrode of the second mirroring transistor is electrically coupled to the node between the light emitting device and the first mirroring transistor;

a switching transistor electrically coupled in series with the second mirroring transistor in the current shunting path; and a controller coupled to a control electrode of the switching transistor, wherein the controller is configured to generate a pulse width modulated control signal that is applied to the control electrode of the switching transistor to vary a current though the current shunting path.

15. The device according to claim 14 wherein the power supply comprises a current controlled power supply, and wherein the light emitting device comprises a first light emitting device, the solid state lighting device further comprising:

a second light emitting device electrically coupled in series between the power supply and the reference node, wherein the first and second light emitting devices are electrically coupled in series between the power supply and the reference node, and wherein a sum of electrical currents through the first light emitting device and the current shunting path is equal to an electrical current through the second light emitting device.

16. The device according to claim 10 wherein the light emitting device comprises a plurality of light emitting devices electrically coupled in series between the power supply and the first mirroring transistor.

17. A device comprising:

a power supply;

a light emitting device electrically coupled between the power supply and a reference node, wherein the light emitting device comprises a plurality of light emitting devices electrically coupled in series between the power supply and the reference node; and a regulating transistor in a current shunting path between the power supply and the reference node wherein the current shunting path is electrically coupled in parallel with the light emitting device, and wherein a control electrode of the regulating transistor is electrically coupled to a node of the light emitting device, wherein the node is between two of the plurality of light emitting devices so that the control electrode of the regulating transistor is electrically coupled to the node between the two of the plurality of light emitting devices.

18. The device according to claim 17 wherein the node between the two of the plurality of light emitting devices comprises a first node, the solid state lighting device further comprising:

a first mirroring transistor electrically coupled in series between the plurality of light emitting devices and the reference node wherein a control electrode of the first mirroring transistor is electrically coupled to a second node between the plurality of light emitting devices and the first mirroring transistor; and a second mirroring transistor wherein a control electrode of the second mirroring transistor is electrically coupled to the second node between the plurality of light emitting devices and the first mirroring transistor, wherein the second mirroring transistor is electrically coupled in series with the regulating transistor in the current shunting path.

19. The device according to claim 18 wherein the regulating transistor comprises a bipolar junction transistor, and wherein the control electrode of the regulating transistor comprises a base of the bipolar junction transistor, the solid state lighting device further comprising:

at least one diode electrically coupled between the base of the bipolar junction transistor and the first node.

20. The device according to claim 18 wherein the regulating transistor comprises a field effect transistor, wherein the control electrode of the regulating transistor comprises a gate of the field effect transistor, and wherein the gate of the field effect transistor is electrically coupled to the first node.

21. A device comprising:

a power supply;

a light emitting device electrically coupled between the power supply and a reference node;

a regulating transistor in a current shunting path between the power supply and the reference node wherein the current shunting path is electrically coupled in parallel with the light emitting device, and wherein a control electrode of the regulating transistor is electrically coupled to a node of the light emitting device;

a switching transistor electrically coupled in series with the regulating transistor in the current shunting path between the power supply and the reference node; and a controller coupled to a control electrode of the switching transistor, wherein the controller is configured to generate a pulse width modulated control signal that is applied to the control electrode of the switching transistor to vary a current though the current shunting path.

22. The device according to claim 21 wherein the power supply comprises a current controlled power supply, and wherein the light emitting device comprises a first light emitting device, the solid state lighting device further comprising:

a second light emitting device electrically coupled in series between the power supply and the reference node, wherein the first and second light emitting devices are electrically coupled in series between the power supply and the reference node, and wherein a sum of electrical currents through the first light emitting device and the current shunting path is equal to an electrical current through the second light emitting device.

23. A method of operating a solid state lighting device including a power supply, a first light emitting device electrically coupled between the power supply and a reference node, and a second light emitting device electrically coupled in series with the first light emitting device, the method comprising:

controlling a voltage drop across a current shunting path by allowing a current through the current shunting path responsive to an electrical signal from a node of the light emitting device, wherein the current shunting path is electrically coupled in parallel with the light emitting device between the power supply and the reference node; and providing a power supply current through the second light emitting device wherein the power supply current is equal to a sum of a current through the first light emitting device and the current through the current shunting path.

24. A method according to claim 23 wherein the current shunting path includes a regulating transistor and a switch electrically coupled in series, the method further comprising:

providing a pulse width modulated control signal to a control electrode of the switch to control a pulse width modulated shunt current through the current shunting path, wherein controlling the voltage drop comprises controlling the regulating transistor responsive to the electrical signal from the node of the light emitting device while providing the pulse width modulated control signal.

25. The device according to claim 10 further comprising:

a switching transistor electrically coupled in series with the second mirroring transistor in the current shunting path.

26. The device according to claim 10 further comprising:

a Zener diode electrically coupled in series with the second mirroring transistor in the current shunting path, wherein the Zener diode is electrically coupled between the second mirroring transistor and the power supply.

27. The device according to claim 1 wherein the control element comprises a bipolar junction transistor including a base, and wherein the base is electrically coupled to the node of the light emitting device.

28. The device according to claim 1 wherein the control element comprises a field effect transistor including a gate, and wherein the gate of the field effect transistor is electrically coupled to the node of the light emitting device.

29. The device according to claim 10 wherein the regulating transistor comprises a bipolar junction transistor, wherein the control electrode comprises a base of the bipolar junction transistor, and wherein the base is electrically coupled to the second node.

30. The device according to claim 17 wherein the regulating transistor comprises a bipolar junction transistor including a base, and wherein the base is electrically coupled to the node of the light emitting device.

31. The device according to claim 17 wherein the regulating transistor comprises a field effect transistor including a gate, and wherein the gate of the field effect transistor is electrically coupled to the node of the light emitting device.

32. The method according to claim 23 wherein the current through the first light emitting device is different than the current through the second light emitting device.

* * * * *